US006601478B1

(12) United States Patent
Hanson

(10) Patent No.: US 6,601,478 B1
(45) Date of Patent: Aug. 5, 2003

(54) EXTENSION ACCESSORY APPARATUS AND METHOD

(76) Inventor: Robert D. Hanson, 3918 N. 24th, Tacoma, WA (US) 98406

( * ) Notice: Subject to any disclaimer, the term of this patent is extended or adjusted under 35 U.S.C. 154(b) by 0 days.

(21) Appl. No.: 09/566,192

(22) Filed: May 5, 2000

Related U.S. Application Data

(60) Provisional application No. 60/133,192, filed on May 7, 1999.

(51) Int. Cl.[7] ..... B25B 23/16

(52) U.S. Cl. ..... 81/177.2; 81/54; 81/467; 81/180.1

(58) Field of Search ..... 81/177.2, 177.1, 81/54, 57.11, 57.14, 436, 467, 469, 180.1

(56) References Cited

U.S. PATENT DOCUMENTS

| | | | |
|---|---|---|---|
| 3,960,199 | A | 6/1976 | Murray |
| 4,076,444 | A | 2/1978 | Siebrecht |
| 4,350,064 | A | 9/1982 | Markle |
| 4,766,783 | A | 8/1988 | Stanich et al. |
| 4,803,904 | A | 2/1989 | Stanich et al. |
| 4,882,958 | A | 11/1989 | McNeeley |
| 4,905,548 | A | 3/1990 | Colace et al. |
| 5,033,337 | A | 7/1991 | Thomas, III |
| 5,154,104 | A | 10/1992 | O |
| 5,231,900 | A | 8/1993 | Deri |
| 5,400,681 | A | 3/1995 | Stranch |
| 6,148,697 | A * | 11/2000 | Perry et al. |
| 6,293,172 | B1 * | 9/2001 | Smith |

* cited by examiner

*Primary Examiner*—Timothy V. Eley
*Assistant Examiner*—Willie Berry, Jr.
(74) *Attorney, Agent, or Firm*—William G. Forster

(57) ABSTRACT

The invention is an extension accessory provided for extending the effective working range/reach of an electric screw gun by adapting the extension accessory to receive and attach to a screw gun to place the same closer to the work surface. The extension accessory is adapted to removably mount and attach to an electrically powered screw gun. The extension accessory comprises a shaft disposed for orientation about a shaft axis that is substantially parallel to the bit rotation axis of the screw gun. The shaft includes a gripping end for gripping the same by the user, and a coupling end for fixedly mounting a screw gun thereto. A first retaining band is supported from the shaft at the coupling end for receiving the body of a screw gun therethrough. Once the body of the screw gun is so received, the first retaining band is adjusted to urge the body of the screw gun toward the shaft for fixing the screw gun thereto. In addition, a second retaining band supported from the shaft, is spaced from the first retaining band for securably receiving the bit receiving nose therethrough. Likewise, the second retaining band is adjustable to urge the bit receiving nose of the screw gun toward the shaft. The distance between the first band and the second band is variable to permit adjustment so that the extension accessory can accommodate a plurality of differently shaped and/or proportioned screw guns.

20 Claims, 3 Drawing Sheets

EXTENSION ACCESSORY APPARATUS AND METHOD

This application claims the benefit of U.S. Provisional Application No. 60/133,192 Filed May 7, 1999.

BACKGROUND

This invention relates generally to portable hand-held power tools such as drills and screw guns, and more particularly to an after-market accessory adapted for attachment to such tools for extending the working range of a person using the same.

A number of systems have been developed for assisting a user thereof to install screws and fasteners in high or otherwise unreachable areas. Many of the early designs incorporated systems directed to motorized and hand operated units, such as a drills, wrenches or the like, having a long extension member extending therefrom to provide means for extending the range of the user. For example, in 1976 U.S. Pat. No. 3,960,191 issued to Murray disclosing an attachment for a portable power screwdriver. In 1978 U.S. Pat. No. 4,076,444 issued to Siebrecht disclosing a drill bit extension which utilized a length pipe for the extension. In 1982 U.S. Pat. No. 4,350,064 issued to Markle disclosing a tool adapted for use with a socket wrench. In 1988 U.S. Pat. No. 4,766,783 issued to Stanich et al disclosing a modified drive rod to replace the original drive rod in a power screwdriver. In 1989 U.S. Pat. No. 4,882,958 issued to McNeeley disclosing a system employing multiple socket heads joined to form a stacked extension. In 1990 U.S. Pat. No. 4,905,548 issued to Colace et al showing an adjustable extension designed for use with ratchet wrenches. Similarly, in 1991 U.S. Pat. No. 5,033,337 issued to Thomas illustrating an extension unit used in conjunction with wrench-type hand tools. In 1992 U.S. Pat. No. 5,154,104 issued to O utilizing a telescoping housing attached to a hand held power tool such as a drill. In 1993 U.S. Pat. No. 5,231,900 issued to Deri directed to an automatic screw feeding mechanism for a conventional drill wherein the drill unit is held in the user's hand. Finally, in 1995 U.S. Pat. No. 5,400,681 issued to Strauch showing an elongate tubular housing that attaches to a hand-held drill.

Although each of the above noted inventions effectively extend the working reach of the user, none are directed to retrofitting an ordinary, readily available screw gun to an extension device wherein modifications to the screw gun or its attachments are unnecessary for the extension of its working reach. Accordingly, a need remains for an inexpensive, simple device adapted to engage a common screw gun to extend the working range thereof by placing the screw gun closer to the surface disposed to receive the fastener.

SUMMARY

One object of the present invention is to increase the productivity of installers of sheet-rock products.

A second object is to increase the speed of installation of sheet-rock.

Another object of the invention is to eliminate the need for ladders, stools and the like when installing sheet rock or the like in high areas.

Yet another object of the present invention is to place the screw gun closer to the sheet-rock or similar material without having the user employ ladders or the like.

A further object is to reduce the time involved to attach an extension device to a screw gun.

Still another object is to increase the safety of work that involves the installation of sheet-rock.

The invention is an extension accessory provided for extending the effective working range/reach of an electric screw gun so that a user thereof can more easily reach areas high overhead. The extension accessory is adapted to removably mount and attach to a screw gun of the type arranged for receiving a replaceable bit that rotates about a bit rotation axis. Such screw guns typically include a housing that defines a handle for griping, a body for supporting and enclosing a drive mechanism, and a bit receiving nose that extends from the body about the bit rotation axis. Accordingly, the bit receiving nose is adapted for receiving the screw bit.

For this purpose, the extension accessory comprises a shaft disposed for orientation about a shaft axis that is substantially parallel to the bit rotation axis of the screw gun. The shaft includes a gripping end for gripping the same by the user, and a coupling end for fixedly mounting a screw gun thereto. Accordingly, a first retaining band is supported from the shaft at the coupling end for receiving the body of a screw gun therethrough. Once the body of the screw gun is so received, the first retaining band is adjusted to urge the body of the screw gun toward the shaft for fixing the screw gun thereto.

In addition, a second retaining band supported from the shaft, is spaced from the first retaining band for securably receiving the bit receiving nose therethrough. Likewise, the second retaining band is adjusted to urge the bit receiving nose of the screw gun toward the shaft for fixing the screw gun thereto. With this configuration, the distance between the first band and the second band is variable to permit adjustment so that the extension accessory can accommodate a plurality of unlike screw guns.

The foregoing and additional objects, features, and advantages of this invention will become more readily apparent from the following detailed description of a preferred embodiment which proceeds with reference to the accompanying drawings. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENT

Figure 1:
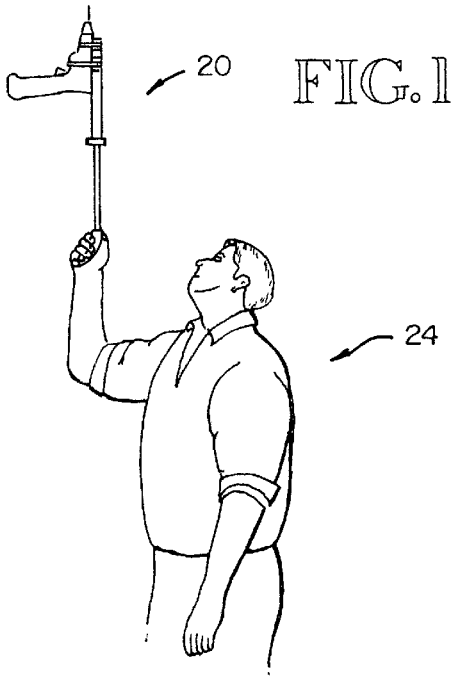
FIG. 1 is a perspective view of an extension accessory used to extend the vertical reach of a person using a screw gun.

Indicated generally at 20 is an extension accessory constructed in accordance with the present invention. The extension accessory 20 is provided for extending the effective working range/reach of an electric screw gun 22 so that a user 24 thereof can more easily reach areas high overhead. The extension accessory 20 is adapted to removably mount and attach to a screw gun 22 of the type arranged for receiving a replaceable bit 26 that rotates about a bit rotation axis 28. Such screw guns typically include a housing 30 that defines a gun handle 32 for griping, a body 34 for supporting and enclosing a drive mechanism (not illustrated), and a bit receiving nose 36 that extends from the body 34 about the bit rotation axis 28. Accordingly, the bit receiving nose 36 is adapted for receiving the screw bit 26.

For this purpose, the extension accessory 20 comprises a shaft 40 disposed for orientation about a shaft axis 44 that is substantially parallel to the bit rotation axis 28 of the screw gun 22. The shaft 40 includes a gripping end 46 for gripping the same by the user 24, and a coupling end 48 for fixedly mounting a screw gun 22 thereto. Accordingly, a first retaining band 50 is supported from the shaft 40 at the coupling end 48 for receiving the body 34 of a screw gun 22 therethrough. Once the body 34 of the screw gun 22 is so received, the first retaining band 50 is adjusted to urge the body 34 of the screw gun 22 toward the shaft 40 for fixing the screw gun 22 thereto.

In addition, a second retaining band 52, supported from the shaft 40, is spaced from the first retaining band 50 for securably receiving the bit receiving nose 36 therethrough. Likewise, the second retaining band 52 is adjusted to urge the bit receiving nose 36 of the screw gun toward the shaft 40 for fixing the screw gun 22 thereto. With this configuration, the distance between the first retaining band 50 and the second retaining band 52 is variable to permit adjustment so that the extension accessory 20 can accommodate a plurality of unlike screw guns.

Considering now in more detail, the components from which an extension accessory 20 is constructed, the shaft 40 is fabricated from readily obtainable materials such as round tubular aluminum. In this way, each retaining band 50, 52 can be secured to the coupling end 48 of shaft 40 by a mounting ring 56. Specifically, a pair of alike mounting rings 56 are constructed from common soft-wall plastic or clear vinyl bendable reinforced tubing. The size of the vinyl tubing is chosen such that the inside diameter of each mounting ring 56 is just slightly less than the exterior diameter of the shaft 40. Accordingly, each mounting ring 56 fits tightly over the shaft 40, but not so tightly to prevent it from sliding along the same with the application of longitudinal force thereon.

With this configuration, each mounting ring 56 can adjustably secure a retaining band to the shaft 40. That is, each mounting ring 56 can be positioned anywhere along the shaft 40 thereby allowing optimal placement of the retaining bands 50, 52 according to the shape and size of a particular screw gun 22.

Figure 3:
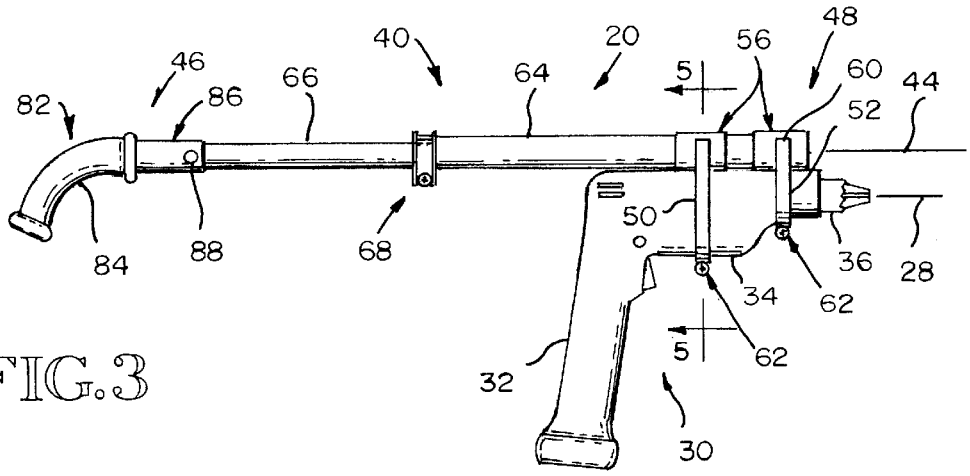
FIG. 3 is a side elevation view of an extension accessory secured to a screw gun by a first retaining band that is drawn around the body of the screw gun, and by a second retaining band that is drawn around the nose of the screw gun.
Figure 4:
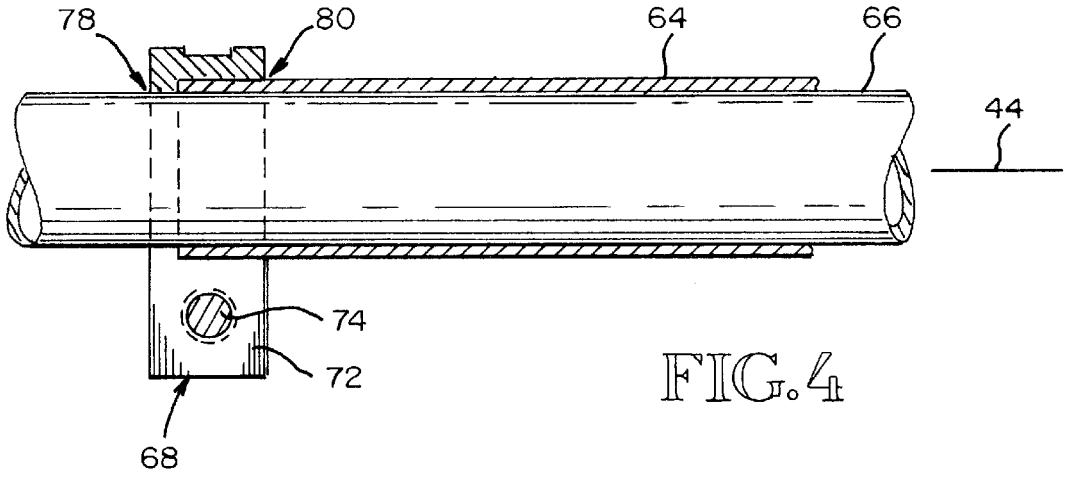
FIG. 4 is a cross-sectional view taken along 4—4 illustrating the adjusting clamp provided for varying the extended range of the extension accessory.
Figure 5:
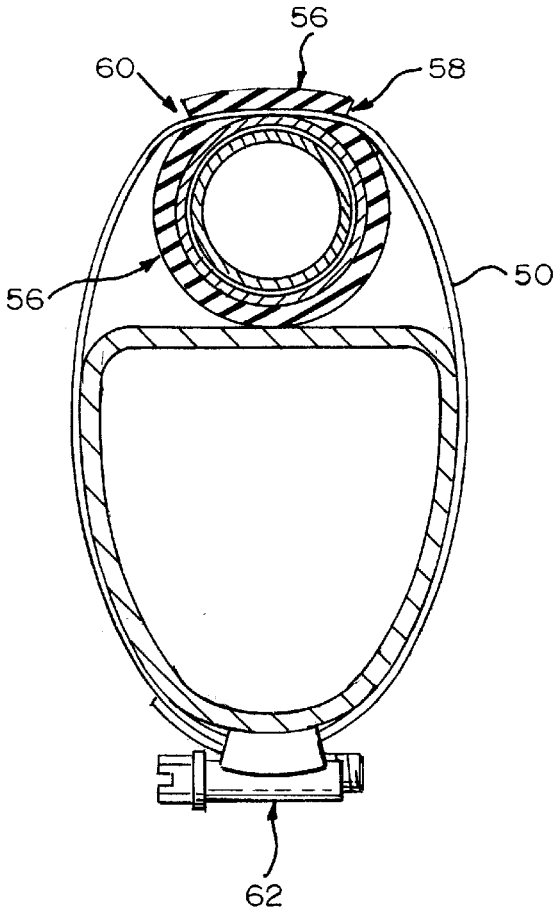
FIG. 5 is a cross-sectional view taken along 5—5 illustrating a retaining band drawn around the body.

Importantly, as best illustrated in FIGS. 3–4 and 5, two parallel slots 58 and 60 are cut into each mounting ring 56. Each slot 58–60 is centrally disposed between the opposing edges of the mounting ring 56 wherein each slot is of a minimal length to allow a retaining band to be threaded therethrough, as noted above, yet the ends of each slot fall well short of the edges of the mounting ring 56, i.e., the full length of the slots 58 and 60 fall well within the edges of the mounting ring. In this way, the integrity of the mounting ring 56 is maintained.

Directing attention to FIG. 5, each mounting ring 56 is rotated such that slots 58, 60 are disposed atop the shaft 40. Further, when slots 58, 60 are formed, in mounting ring 56, the same are spaced apart so that a retaining band can be received, i.e., directed through one slot 58, extending along the radially inner surface of the mounting ring 56, and exiting out the other slot 60. Accordingly, a portion of the respective retaining band is held adjacent the shaft 40, between the shaft 40 and the mounting ring 56. This configuration secures the retaining band to the shaft 40 in proper position so that the retaining band can urge the shaft 40 and a portion of the screw gun 22 together. Moreover, this arrangement prevents the band from separating from the shaft 40 when a screw gun 22 is withdrawn from the bands.

In the present invention, the retaining bands 50, 52 are constructed from common readily available stainless steel strap clamps that can be found in any plumbing supply outlet. In the preferred embodiment, the retaining bands 50, 52 are substantially covered with a thin plastic (not illustrated) to protect the user from the sharp edges of the retaining bands. This type of retaining band includes a screw mechanism 62 that is employed to adjust the length of the band. Accordingly, each retaining band 50, 52 is adjustable from a first expanded diameter arrangement to receive a portion of the screw gun therethrough, to a second restricted, i.e. constricted diameter arrangement to tightly grip the screw gun, urging the same against the shaft 40 so that the screw gun 22 is fixedly mounted to the shaft 40 of extension accessory 20. Because typical screw guns are constructed with a relatively large body 34 and a relatively small bit receiving nose 36, the wide range of adjustment of retaining bands 50, 52 permits the user to quickly adjust the same to secure any of a variety of screw guns in proper working position.

Figure 2:
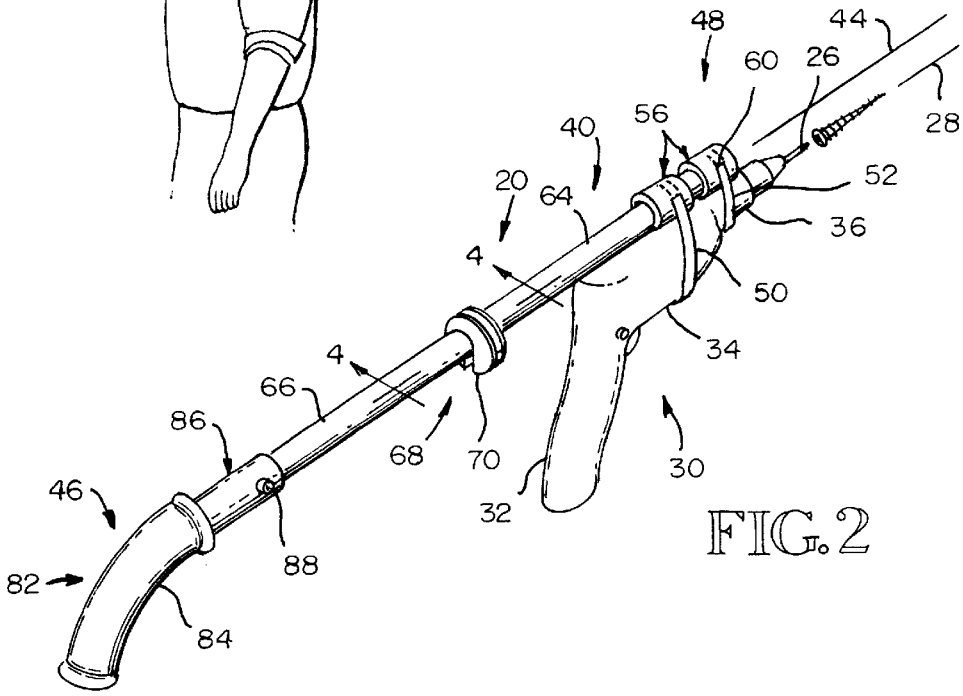
FIG. 2 is a rear perspective view of an extension accessory secured and releasably mounted to a screw gun.

Turning now to FIGS. 2 through 4, a shaft 40 constructed in accordance with the preferred embodiment is illustrated. Importantly, the shaft 40 comprises two sections: a receiver section 64 and a retractable section 66. Each section is tubular, wherein the inside diameter of the receiver section 64 is slightly larger than the outside diameter of the retractable section 66. In this way, the retractable section 66 can collapse within the receiver section 64 thereby allowing the user to vary the length of the shaft 40. This allows the user to optimally compensate, i.e., shorten or lengthen shaft 40 according to the height of the overhead work surface where the placement of screws is required.

In order to maintain the receiver section 64 in relation to the retractable section 66, a split ring clamp 68 is employed. In this embodiment, the split ring clamp 68 is of the type commonly used in bicycles to position the seat in relation to the frame. In this embodiment, the split ring clamp 68 is disposed at the junction where the retractable section 66 enters the receiver section 64. Accordingly, a portion of the split ring clamp 68 is disposed around the receiver section 64, and a portion of the clamp is disposed around the retractable section 66. For this purpose, the split ring clamp 68 is constructed to form an increased diameter clamping surface 78 for contacting the smaller diameter retractable section 66, and a reduced diameter stepped surface 80 for contacting the larger diameter receiver section 64.

Additionally, the split ring clamp 68 comprises a slit 70 which defines opposing slit surfaces of which only one is illustrated—slit surface 72. In use, a fastener 74 is disposed through the split ring clamp 68 such that the slit 70 can be closed thereby tightening the split ring clamp 68 around both the receiver section 64 and the retractable section 66. As the split ring clamp 68 is so adjusted, the receiver section 64 is fixed relative to the retractable section 66.

In addition to the above, the preferred embodiment includes a grip 82 that is provided for the comfort of the user at the gripping end 46 of the extension accessory 20. The grip 82 comprises a tubular rubber member 84 fitted over a slightly curved tubular handle 86. The tubular handle 86 is constructed with an inner diameter sized to fit over the retractable section 66. In this way a fastener 88 can be placed through both the handle 86 and the retractable section 66 to fixedly secure the two together.

Figure 6:
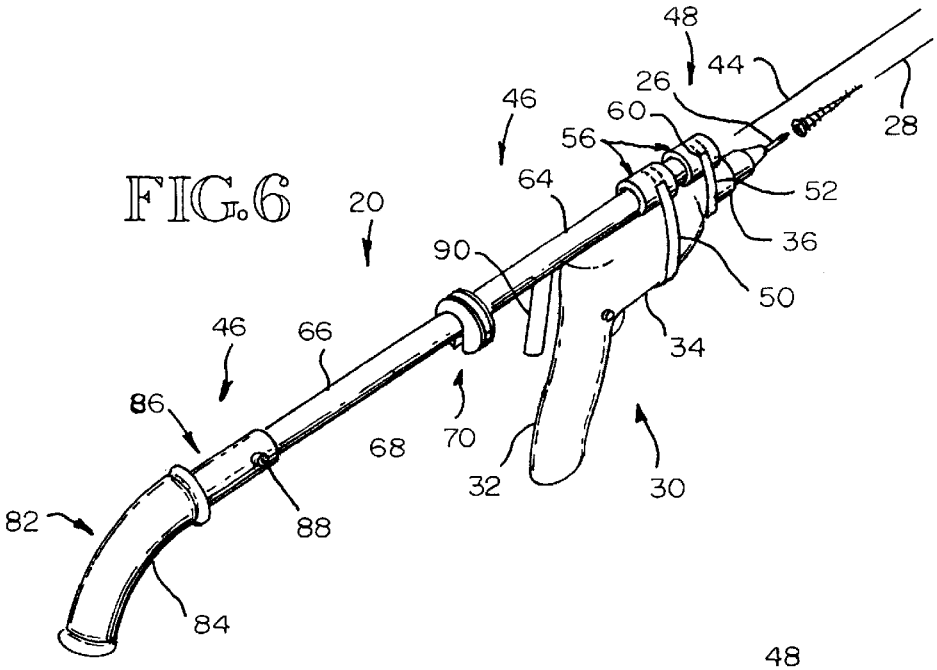
FIG. 6 is a rear perspective view of an alternate embodiment extension accessory having a stop member disposed to prevent rearward movement of a power tool.
Figure 7:
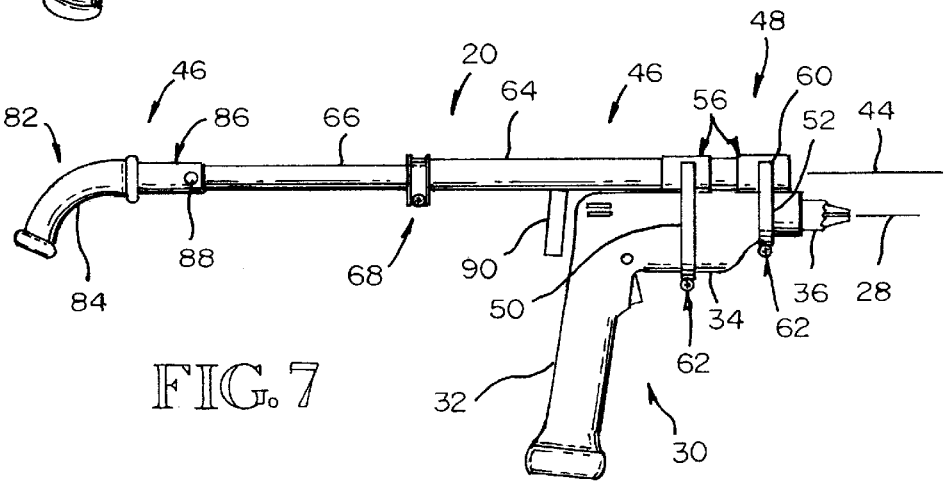
FIG. 7 is a side elevation view of an alternate embodiment extension accessory secured to a screw gun by a first band that is drawn around the body of the screw gun and a second band that is drawn around the nose of the screw gun wherein a stop member disposed to prevent rearward movement of a power tool.

Directing attention to FIGS. 6 and 7, an alternate embodiment is illustrated. Included therein is a stop member 90 which is attached to the shaft 40. The stop member 90 is so attached such that it extends downward to contact the rear portion of a properly mounted screw gun 22. With this arrangement, the stop member 90 is positioned to prevent rearward movement of a screw gun 22 in those situations where a user 24 must apply extra force in the placement of a screw. It should be noted that a stop member 90 could be constructed in many various ways. One such way would be to weld a lug directly to the retractable section 66, to the rear of the screw gun 22.

Figure 8:
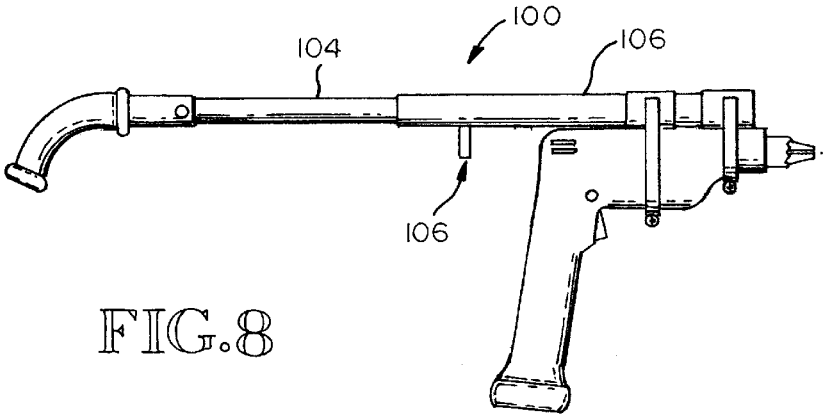
FIG. 8 is a side elevation view of an extension accessory wherein the shaft thereof comprises telescoping sections that are locked together by a button lock.

Turning now to FIG. 8, an additional embodiment is illustrated showing a telescoping shaft assembly 100 that comprises a receiver section 102 disposed to receive a retractable section 104. Importantly, all other components of the extension accessory 20 are constructed and disposed as noted above. Typically, readily available telescopic tubes are employed which include button locks that employ a spring activated retractable button 106 to relatively lock the sections together. Such telescopic assemblies can be obtained from a wide variety of sources including for example JTD Enterprises located in Troy Mich. Similarly, other readily available, compatable, telescopic shaft assemblies comprise cam locks (not illustrated) to relatively lock the opposing sections. Likewise, such assemblies are available through manufactures such as JTD Enterprises. It should be noted that the specific construction of such telescopic assemblies is beyond the scope of this disclosure.

Finally, the present invention includes the method of making an extension accessory. In brief, the method includes the steps of providing a shaft disposed for orientation about a shaft axis substantially parallel to the bit rotation axis of the screw gun. The shaft includes a gripping end for gripping the same by the user, and a coupling end for coupling and securing a screw gun thereto. An additional step includes supporting a first retaining band from the shaft at the coupling end for receiving the body of a screw gun therethrough. The first retaining band being adjustable to urge the body of the screw gun toward the shaft for fixing the screw gun thereto.

Likewise, a second retaining band is supported from the shaft, spaced from the first retaining band for securably receiving the bit receiving nose therethrough. The second retaining band being adjustable to urge the bit receiving nose of the screw gun toward the shaft for fixing the screw gun thereto. Importantly, the distance between the first retaining band and the second retaining band is variable to permit adjustment to accommodate a plurality of unlike screw guns.

Moreover, each retaining band is adjustable from a first expanded diameter arrangement to receive a portion of the screw gun therethrough, to a second constricted arrangement to tightly grip the screw gun, urging the same against the shaft so that the screw gun is fixedly mounted to the extension accessory.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. An extension accessory for extending the effective range and reach of an electric screw gun of the type arranged for receiving a replaceable bit that rotates about a bit rotation axis, the screw gun having a housing that defines a handle for griping and a body for supporting and enclosing an electric motor, and a bit receiving nose extending from the body along the bit rotation axis for receiving the screw bit, the extension accessory comprising:

a shaft disposed for orientation about a shaft axis substantially parallel to the bit rotation axis of the screw gun, the shaft having a gripping end for gripping the same by the user, and a coupling end for coupling and securing a screw gun thereto;

a first retaining band supported from the shaft at the coupling end for securably receiving the body of a screw gun therethrough;

a second retaining band supported from the shaft, spaced from the first retaining band for securably receiving the bit receiving nose therethrough; and wherein the distance between the first retaining band and the second retaining band is variable to permit adjustment to accommodate a plurality of unlike screw guns.

2. An extension accessory as recited in claim 1 further comprising a mounting ring for each retaining band to secure the same to the shaft, wherein a portion of the mounting ring is arranged to receive a retaining band such that the retaining band encircles a portion of the screw gun as well as the shaft to urge the screw gun toward the shaft.

3. An extension accessory as recited in claim 2 wherein each retaining band is adjustable from a first expanded configuration to receive a portion of the screw gun therethrough, to a second constricted configuration to tightly grip the screw gun, urging the same against the shaft so that the screw gun is fixedly mounted to the extension accessory.

4. An extension accessory as recited in claim 3 wherein a portion of the shaft defines an extension handle for griping by the user.

5. An extension accessory as recited in claim 4 wherein the length of the shaft is adjustable from a first compact and shortened configuration to a second extended and lengthened configuration thereby further extending the reach of the tool.

6. An extension accessory as recited in claim 2 wherein each retaining band is secured between a portion of a mounting ring and the shaft.

7. An extension accessory as recited in claim 1 wherein the length of the shaft is adjustable from a first compact and shortened configuration to a second extended and lengthened configuration thereby further extending the reach of the tool.

8. An extension accessory as recited in claim 1 wherein the shaft further comprises a stop member disposed to extend downward to contact the rear portion of a properly mounted screw gun to prevent rearward movement thereof.

9. An extension accessory for extending the effective range and reach of an electric screw gun of the type arranged for receiving a replaceable bit that rotates about a bit rotation axis, the screw gun having a housing that defines a handle for griping and a body for supporting and enclosing an electric motor, and a bit receiving nose extending from the body along the bit rotation axis for receiving the screw bit, the extension accessory comprising:

a shaft disposed for orientation about a shaft axis substantially parallel to the bit rotation axis of the screw gun, the shaft having a gripping end for gripping the same by the user, and a coupling end for coupling and securing a screw gun thereto;

a first retaining band supported from the shaft at the coupling end for securably receiving the body of a screw gun therethrough;

a second retaining band supported from the shaft, spaced from the first retaining band for securably receiving the bit receiving nose therethrough; and wherein each retaining band is adjustable from a first expanded arrangement to receive a portion of the screw gun therethrough, to a second constricted arrangement to tightly grip the screw gun, urging the same against the shaft so that the screw gun is fixedly mounted to the extension accessory.

10. An extension accessory as recited in claim 9 further comprising a mounting ring for each retaining band to secure the same to the shaft, wherein a portion of the mounting ring is arranged to receive a retaining band such that the retaining band encircles a portion of the screw gun as well as the shaft to urge the screw gun toward the shaft.

11. An extension accessory as recited in claim 10 wherein each band is secured between a portion of a mounting ring and the shaft.

12. An extension accessory as recited in claim 9 wherein a portion of the shaft defines an extension handle for griping by the user.

13. An extension accessory as recited in claim 12 wherein the length of the shaft is adjustable from a first compact and shortened configuration to a second extended and lengthened configuration thereby further extending the reach of the tool.

14. An extension accessory as recited in claim 9 wherein the shaft further comprises a stop member disposed to extend downward to contact the rear portion of a properly mounted screw gun to prevent rearward movement thereof.

15. A method for making an extension accessory for extending the effective range and reach of an electric screw gun of the type arranged for receiving a replaceable bit that rotates about a bit rotation axis, the screw gun having a housing that defines a handle for griping and a body for supporting and enclosing an electric motor, and a bit receiving nose extending from the body along the bit rotation axis for receiving the screw bit, the method comprising the steps:

providing a shaft disposed for orientation about a shaft axis substantially parallel to the bit rotation axis of the screw gun, the shaft having a gripping end for gripping the same by the user, and a coupling end for coupling and securing a screw gun thereto;

supporting a first retaining band from the shaft at the coupling end for securably receiving the body of a screw gun therethrough;

supporting a second retaining band from the shaft, spaced from the first retaining band for securably receiving the bit receiving nose therethrough; and Wherein the distance between the first retaining band and the second retaining band is variable to permit adjustment to accommodate a plurality of unlike screw guns;

wherein each retaining band is adjustable from a first expanded arrangement to receive a portion of the screw gun therethrough, to a second constricted arrangement to tightly grip the screw gun, urging the same against the shaft so that the screw gun is fixedly mounted to the extension accessory.

16. A method of making an extension accessory as recited in claim 15 further comprising the step of providing a mounting ring for each retaining band to secure the same to the shaft, wherein a portion of the mounting ring is arranged to receive a retaining band such that the retaining band encircles a portion of the screw gun as well as the shaft to urge the screw gun toward the shaft.

17. A method of making an extension accessory as recited in claim 15 wherein each band is secured between a portion of a mounting ring and the shaft.

18. A method of making an extension accessory as recited in claim 15 wherein a portion of the shaft defines an extension handle for griping by the user.

19. A method of making an extension accessory as recited in claim 15 wherein the length of the shaft is adjustable from a first compact and shortened configuration to a second extended and lengthened configuration thereby further extending the reach of the tool.

20. An extension accessory as recited in claim 15 further comprising the step of providing a stop member disposed to extend downward from the shaft to contact the rear portion of a properly mounted screw gun to prevent rearward movement thereof.

* * * * *